US010109438B2

(12) United States Patent
Steinbauer

(10) Patent No.: US 10,109,438 B2
(45) Date of Patent: Oct. 23, 2018

(54) METHOD AND CONTACT SLIDE UNIT FOR A SWITCH UNIT

(71) Applicant: Siemens Aktiengesellschaft, Munich (DE)

(72) Inventor: Martin Steinbauer, Schmidmuehlen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 15/304,786

(22) PCT Filed: May 9, 2014

(86) PCT No.: PCT/EP2014/059549

§ 371 (c)(1),
(2) Date: Oct. 17, 2016

(87) PCT Pub. No.: WO2015/169390

PCT Pub. Date: Nov. 12, 2015

(65) Prior Publication Data

US 2017/0047177 A1 Feb. 16, 2017

(51) Int. Cl.

| | |
|---|---|
| ***H01H 1/36*** | (2006.01) |
| ***H01H 15/04*** | (2006.01) |
| ***H01H 1/20*** | (2006.01) |
| ***H01H 11/00*** | (2006.01) |
| ***H01H 15/10*** | (2006.01) |
| *H01H 73/04* | (2006.01) |
| *H01H 1/30* | (2006.01) |
| *H01H 11/06* | (2006.01) |

(52) U.S. Cl.

CPC ..... *H01H 15/04* (2013.01); *H01H 1/20* (2013.01); *H01H 1/2008* (2013.01); *H01H 11/00* (2013.01); *H01H 15/10* (2013.01); *H01H 1/30* (2013.01); *H01H 11/06* (2013.01); *H01H 73/045* (2013.01)

(58) Field of Classification Search

CPC ..... H01H 15/04; H01H 15/10; H01H 11/00; H01H 1/20; H01H 1/2008; H01H 73/045; H01H 11/06; H01H 1/30

USPC ..... 200/252, 329

See application file for complete search history.

(56) References Cited

U.S. PATENT DOCUMENTS

| | | | | |
|---|---|---|---|---|
| 9,024,215 | B2 * | 5/2015 | Chiba | H01H 1/44 200/16 R |
| 2014/0224629 | A1 * | 8/2014 | Rosch | H01H 1/20 200/329 |
| 2014/0231235 | A1 | 8/2014 | Roesch et al. | |

FOREIGN PATENT DOCUMENTS

| | | |
|---|---|---|
| CN | 202230921 | 5/2012 |
| DE | 11 54 553 B | 9/1963 |
| DE | 10 2007 015 794 A1 | 10/2008 |

(Continued)

OTHER PUBLICATIONS

Office Action dated Apr. 20, 2017 which issued in the corresponding Chinese Patent Application No. 2014800727936.

*Primary Examiner* — Edwin A. Leon
*Assistant Examiner* — Lheiren Mae A Caroc
(74) *Attorney, Agent, or Firm* — Cozen O'Connor

(57) ABSTRACT

A contact slide unit for a switch unit, where the contact slide unit includes a contact slide with a switching piece displaceably guided therein, and method for mounting the contact slide unit, where the displaceable switching piece is protected on the contact slide against twisting via a separately formed anti-twist stop.

9 Claims, 5 Drawing Sheets

(56) References Cited

FOREIGN PATENT DOCUMENTS

| | | | |
|---|---|---|---|
| EP | 2 515 317 | A1 | 10/2012 |
| EP | 2 704 171 | A1 | 3/2014 |
| WO | WO 2013/139385 | | 9/2013 |
| WO | WO 2013/139386 | A1 | 9/2013 |

* cited by examiner

METHOD AND CONTACT SLIDE UNIT FOR A SWITCH UNIT

CROSS-REFERENCE TO RELATED APPLICATIONS

This is a U.S. national stage of application No. PCT/EP2014/059549 filed 9 May 2014.

BACKGROUND OF THE INVENTION

1. Field of the Invention

The invention relates to a method and contact slide unit for a switching unit, having a contact slide with a movable switching piece guided therein.

2. Description of the Related Art

Switching units, in particular circuit breakers, are used inter alia for safe disconnection in the event of a short circuit and, thus, protect consumers and installations. Furthermore, electrical or mechanical switching units are suitable for the operationally dependent, manual switching of consumers and for the safe isolation of an installation from the electrical grid in the event of maintenance work or changes to the installation. Electrical switching units are often operated electromagnetically.

In other words, such switching units are electrical switching devices that are high quality in technical terms with integrated protection for motors, lines, transformers and generators. Switching units are used at service facilities with a low switching frequency. In addition to short-circuit protection, such switching units are also suitable for overload protection.

In the event of a short circuit, an electrical switching unit disconnects an electrical installation safely. Thus, this electrical switching unit provides safety protection from overload. Any conductor through which current is flowing is heated to a greater or lesser extent. In this case, the heating is dependent on the ratio of the current intensity to the conductor cross section, known as the current density. The current density should not become too great because otherwise the conductor insulation can be scorched by excessive heating and possibly a fire can be triggered.

Circuit breakers have two tripping mechanisms that act independently of one another for overload and short-circuit protection. Both releases are connected in series. In the event of a short circuit, an electromagnetic release that acts virtually without any delay in time performs the protection function. In the event of a short circuit, the electromagnetic release unlatches a switching mechanism of the circuit breaker without any delay. A switching armature isolates the switching piece before the short-circuit current can reach its maximum value.

In circuit breakers having a high switching capacity ($I_{CU}$ up to 100 kA at a rated current of $I_N$=100 A), high short circuits occur, with the result that in turn large magnetic forces arise between the movable switching piece and the fixed switching piece. These are, for one part, current-loop forces between the fixed switching piece and the movable switching piece and, for another part, the much greater current constriction forces between the silver contacts. These two forces have the effect that, in the event of a short circuit, the movable switching piece is suddenly thrown counter to the resulting spring force thereof and strikes the impact domes in the lower part.

Furthermore, the abovementioned current constriction forces between the silver contacts do not act centrally in the middle of the contacts but decentrally further toward the periphery of the contacts. In addition to the opening force in the direction of the impact domes in the lower part, the movable switching piece therefore experiences a torque that can result in rotation of the movable switching piece about the longitudinal axis. In addition, the striking of the impact domes, can also have the effect, given an unfavorable position of the movable switching piece, that an undesired torque is again initiated.

Under extreme load, it is occasionally possible for the movable switching piece to exploit its design-determined degrees of freedom and, as a result of the initiated torques, for it to either become wedged in the contact slide or rotate so far that regular contact between the contacts of the movable switching piece and the fixed switching piece is no longer possible. In any case, reliable operation of the circuit breaker is no longer ensured.

Known contact slides of these slide units frequently have two guide systems, i.e., an internal guide system and an external guide system. The external guide system is used when the switching operation, i.e., the switch-on or switch-off operation, occurs via a switching mechanism of the switching unit. In this case, no bridge rotator occurs.

The internal guide system is used in the event of a short circuit when the switching operation is performed via a switching armature, frequently a plunger, of the switching unit. In other words, in the event of disconnection on account of a short circuit, the movable switching piece extends ahead of the contact slide along the internal guide system, rebounds at the impact faces in what is referred to as the lower part of the switching unit and flies back along the internal guide system again. In this case, it flies in the opposite direction to the switching armature or the plunger of the switching unit. Here, it is possible for the movable switching piece and the plunger to meet one another outside their center lines, and this can lead to rotation of the movable switching piece about its longitudinal axis.

If the movable switching piece remains in the rotated state, when the switching unit is next switched on, the contacts, in particular silver contacts of the movable switching piece and the fixed contacts of the switching unit, no longer meet one another, with the result that the failure phenomena occurs. In other words, a switching piece that remains in a rotated position is disadvantageous because the switching unit is then no longer usable. A non-functioning switching piece and a non-functioning switching unit are disadvantageous for the electrical consumers and the installation in which the switching unit is installed.

SUMMARY OF THE INVENTION

Accordingly, it is an object of the present invention to provide a contact slide unit for a switching unit, which is configured such that bridge rotators of the switching piece are avoided, and to provide a method for mounting this contact slide unit.

This and other objects and advantages are achieved in accordance with the invention by a contact slide unit which has a contact slide with a movable switching piece guided therein, where the movable switching piece is positioned in the contact slide in a manner such that it is prevented from rotating by a separately configured rotation prevention device.

By way of a preferably stamped and bent metal plate that is connected to the movable switching piece, i.e., the bridge, via a kind of bayonet connection, the guide surfaces of the movable switching piece are laterally enlarged. As a result, in the fully mounted state, in conjunction with the contact slide, it can no longer tip or even rotate through 90° or more. Here, the metal rotation prevention plate is in this case configured such that it is not necessary to deviate from the original mounting process of the switching unit, in particular of the circuit breaker. All that is required are minor modifications to the contact slide and correction of the stamped bridge geometry.

The contact slide unit in accordance with the invention is mounted in several steps. First, the bridge is guided obliquely between the lateral guides of the contact slide, and then straightened and placed on the feet of the contact slide that act as mounting aids. As a result of the stamped bridge geometry being corrected, openings arise between the rounded guide surfaces of the contact slide and the bridge geometry, where the openings are provided for the metal rotation prevention plate. Once the metal rotation prevention plate has been plugged into the opening, the combination of metal plate and bridge is pushed upwardly in the contact slide into its fitted position via the contact load spring. As a result of the integrally formed contour of the metal rotation prevention plate in conjunction with the integrally formed region in the contact slide, the metal rotation prevention plate is oriented correctly. The bayonet connection then encloses the bridge, with the result that the two parts, i.e., the bridge and the metal plate, are connected together in a form-fitting manner.

If the bridge is now thrown downward by the current constriction forces and current-loop forces, it is held securely in position by the metal rotation prevention plate, even when a torque acts on the bridge as a result of eccentric force introduction. Thus, tipping or tilting of the bridge in the contact slide is no longer possible.

As a result of the bridge being connected to the metal rotation prevention plate, the guide webs of the bridge are extended from 3 mm to 12 mm. Even in the event of eccentric introduction of the current constriction forces and current-loop forces, which act on the bridge in the event of a short circuit and throw the bridge against the impact domes in the lower part, the bridge is guided effectively by the metal rotation prevention plate. Tipping or tilting of the bridge is thus no longer possible and reliable contact between the fixed switching pieces and the bridge is ensured after a short circuit. By way of the bayonet connection and the oppositely integrally formed regions on the metal rotation prevention plate and on the contact slide, the original mounting sequence can be retained. As a result, furthermore, only two minor modifications to existing tools are necessary as a result.

In a particularly advantageous embodiment of the invention, the rotation prevention device is a stamped and bent sheet-metal part. The rotation prevention device in accordance with the invention is thus easy to produce and does not require any complicated mounting sequences. The production costs are additionally low.

In a further embodiment in accordance with the invention, the rotation prevention device is configured in a U-shaped manner with a support plate as central region and two guide webs arranged laterally thereon. Here, the support plate serves as a support surface for the movable switching piece, while the guide webs serve as guide elements during the mounting of the rotation prevention device and prevent rotation of the movable switching piece in the final mounting position.

In a specific embodiment of the invention, the guide webs of the rotation prevention device have a first insertion bevel. The first insertion bevels formed on the guide webs are each guided to their final mounting position by insertion bevels arranged in the contact switch. As a result of the clear assignment between the respective insertion bevels, there is no longer room for a bridge rotator.

In a further specific embodiment in accordance with the invention, the first insertion bevels are arranged on the rotation prevention device in a mirror-inverted manner opposite one another. Here, mirror-inverted means that the first insertion bevels are arranged on the rotation prevention device in a rotationally symmetrical manner to a vertical axis that extends vertically on the longitudinal axis of the movable switching piece.

In a particularly preferred embodiment of the invention, second insertion bevels, upon which the first insertion bevels of the rotation prevention device are guided during the positioning of the rotation prevention device in the contact slide, are arranged in the contact slide. The first insertion bevels are coordinated with the second insertion bevels of the contact slide with respect to positioning and configuration such that, when the rotation prevention device is positioned in the contact slide, the possibility of a bridge rotator can be ruled out.

In a specific embodiment of the invention, the movable switching piece has two protrusions that are arranged in a mirror-inverted manner opposite one another. Here, mirror-inverted also means that the protrusions are arranged in a rotationally symmetrical manner to a vertical axis which extends vertically from the longitudinal axis of the movable switching piece. These protrusions on the movable switching piece have a stopper function for the rotation prevention device, because the guide webs of the rotation prevention device bear against these protrusions and thus make rotation of the movable switching piece impossible. In this case, it is possible to form the protrusions on the movable switching piece such that they hold the rotation prevention device in a manner such that it is prevented from rotating in its final mounting position on the movable switching piece. Thus, the protrusions on the movable switching piece serve, in the final mounting position of the rotation prevention device, as stoppers that prevent the movable switching piece from moving in its longitudinal direction.

In another embodiment, the contact slide in accordance with the invention is used in a circuit breaker.

It is also an object of the present invention to provide a method for mounting a contact slide unit for a switching unit having a contact slide and a movable switching piece guided therein. In accordance with the invention, the method is performed by the steps of introducing the movable switching piece obliquely between lateral guides of the contact slide, straightening up the movable switching piece on feet of the contact slide, introducing the rotation prevention device into an opening in the contact slide, and aligning the rotation prevention device with the movable switching piece.

The contact slide unit in accordance with the invention for a switching unit has a contact slide with a movable switching piece guided therein. The contact slide is preferably configured in a U-shaped manner with a central region and two lateral guides arranged opposite one another. The lateral guides lead, at their first ends, into the central region and have, at their second ends, feet that are configured as a support surface for the movable switching piece. The feet have preferably semiconcentric recesses. Openings that serve to receive a rotation prevention device are positioned in a diagonally opposing manner on the feet.

The rotation prevention device is preferably a stamped and bent sheet-metal part, which is preferably configured in a U-shaped manner, and has a support plate as the central region and two guide webs arranged laterally thereon. The guide webs of the rotation prevention device have a first insertion bevel, where the insertion bevels on the guide webs are positioned in a mirror-inverted manner opposite one another. Here, mirror-inverted means that the insertion bevels are arranged in a rotationally symmetrical manner to one another, where the rotation axis extends perpendicularly from the longitudinal axis of the movable switching piece. In addition to the insertion bevel, the guide webs also have a straight insertion portion.

In order to position the rotation prevention device, the guide webs are introduced into the openings, arranged in a diagonally opposing manner, in the contact slide. For the final mounting of the rotation prevention device, it is rotated into the semiconcentric recess of the feet of the contact slide. This is possible because the support plate of the rotation prevention device has semiconcentric convexities on two side edges arranged opposite one another. The insertion bevels of the rotation prevention device are guided into the final mounting position by second insertion bevels that are positioned in the contact slide.

In the final mounting position of the rotation prevention device, the straight insertion portions of the guide webs of the rotation prevention device bear against protrusions that are arranged on the movable switching piece in a mirror-inverted manner opposite one another. The protrusions on the movable switching piece exert a stopper function that results in the movable switching piece not producing any bridge rotator.

The contact slide unit in accordance with the invention is characterized by the connection of the bridge to the rotation prevention device, with the result that the guide surfaces of the bridge can be considerably increased. Even in the event of eccentric introduction of current constriction forces and current-loop forces, which act on the bridge in the event of a short circuit and throw it against the impact domes in the lower part, the bridge is guided effectively by the metal rotation prevention plate. Tipping or tilting of the bridge is thus no longer possible and reliable contacting between the fixed switching piece and the bridge is ensured after a short circuit. As a result of the bayonet connection and the oppositely integrally formed regions on the metal rotation prevention plate and on the contact slide, the original mounting sequence can be retained. Furthermore, only two minor modifications to the existing tools are required.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

Further advantages and embodiments of the invention are explained in more detail in the following text with reference to exemplary embodiments and with reference to the drawing, in which, schematically.

DETAILED DESCRIPTION OF THE EXEMPLARY EMBODIMENTS

Figure 1:
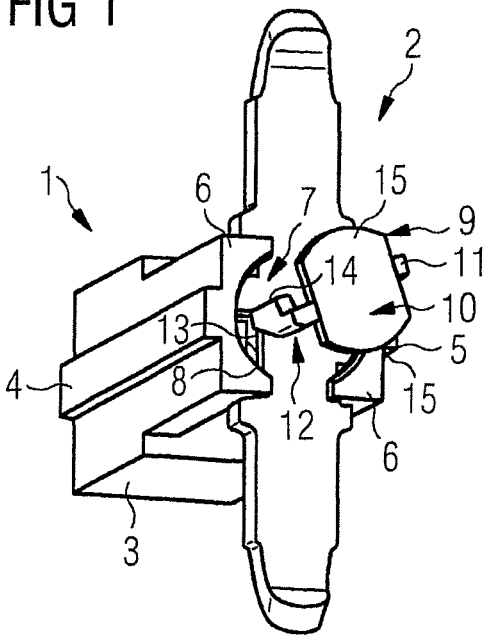
FIG. 1 shows a perspective illustration of a contact slide unit, having a contact slide, a movable switching piece and a rotation prevention device in accordance with the invention.

FIG. 1 shows a contact slide unit in accordance with the invention for a switching unit, which has a contact slide 1 with a movable switching piece 2 guided therein. The contact slide 1 is preferably configured in a U-shaped manner with a central region 3 and two lateral guides 4, 5 arranged opposite one another. The lateral guides 4, 5 lead, at their first ends, into the central region 3 and have, at their second ends, feet 6 that are configured as a support surface for the movable switching piece 2. The feet 6 have preferably semiconcentric recesses 7. Openings 8 that serve to receive a rotation prevention device 9 are positioned in a diagonally opposing manner on the feet 6.

The rotation prevention device 9 is preferably a stamped and bent sheet-metal part, which is preferably configured in a U-shaped manner, having a support plate 10 as the central region and two guide webs 11, 12 arranged laterally thereon. The guide webs 11, 12 of the rotation prevention device 9 have a first insertion bevel 13, where the insertion bevels 13 on the guide webs 11, 12 are positioned in a mirror-inverted manner opposite one another. Here, mirror-inverted means that the insertion bevels 13 are arranged in a rotationally symmetrical manner to one another, where the rotation axis stands perpendicularly on the longitudinal axis of the movable switching piece 2.

In addition to the insertion bevel 13, the guide webs 11, 12 also have a straight insertion portion 14. In order to position the rotation prevention device 9, the guide webs 11, 12 are introduced into the openings 8, arranged in a diagonally opposing manner, in the contact slide 1. For the final mounting of the rotation prevention device 9, it is rotated into the semiconcentric recess 7 of the feet 6 of the contact slide 1. This is possible because the support plate 10 of the rotation prevention device 9 has semiconcentric convexities 15 on two side edges arranged opposite one another. The insertion bevels 13 of the rotation prevention device 9 are guided into the final mounting position by second insertion bevels that are positioned in the contact slide.

Figure 2:
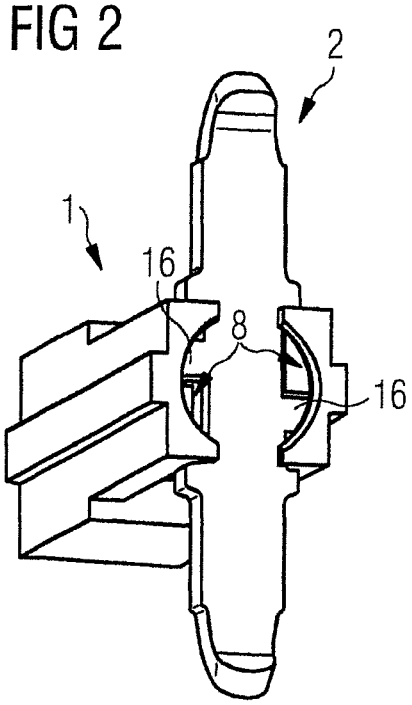
FIG. 2 shows a perspective illustration from below of the contact slide of FIG. 1 with an inserted movable switching piece.

FIG. 2 shows the arrangement of the contact slide 1 and inserted movable switching piece 2 without the rotation prevention device 9. It is clear from this illustration that the movable switching piece 2 has, on the longitudinal sides, protrusions 16 that are arranged in a mirror-inverted manner opposite one another. The protrusions 16 on the movable switching piece 2 exert a stopper function that results in the movable switching piece not producing any bridge rotator. In the final mounting position of the rotation prevention device 9, the insertion bevels 14 of the guide webs 11, 12 of the rotation prevention device 9 bear against the protrusions 16 that are arranged on the movable switching piece 2. The openings 8, arranged in a diagonally opposing manner, in the contact slide 1 can also be seen in FIG. 2.

Figure 3:
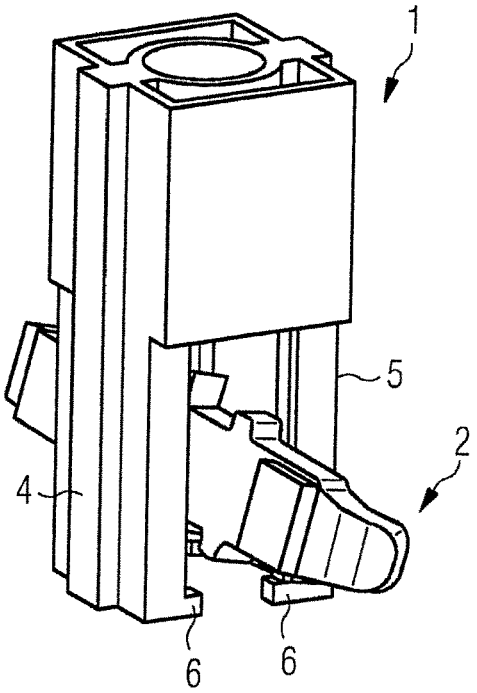
FIG. 3 shows a perspective illustration from the side of the contact slide of FIG. 1 with an obliquely inserted movable switching piece.

FIG. 3 shows the contact slide 1 with an obliquely inserted movable switching piece 2. During mounting, the movable switching piece 2 is initially introduced obliquely between the guide webs 11, 12 of the contact slide 1 and then rotated through 90° such that the movable switching piece 2 rests on the feet 6 of the contact slide 1.

Figure 4:
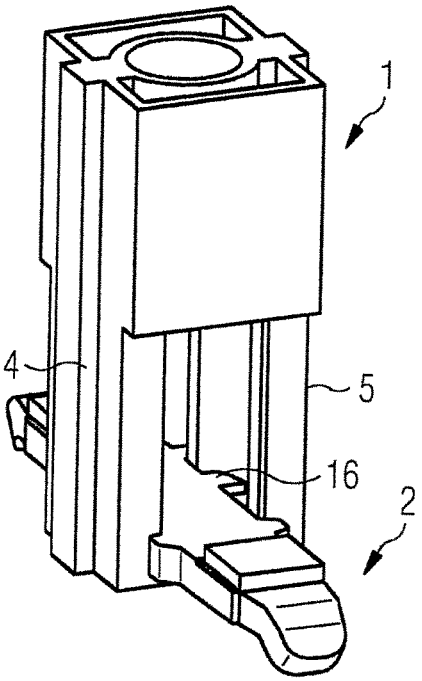
FIG. 4 shows a perspective illustration from above of the contact slide of FIG. 1 with an inserted movable switching piece.

FIG. 4 illustrates the final mounting position of the movable switching piece 2 in the contact slide 1, after the movable switching piece 2 has been rotated through 90°.

Figure 5:
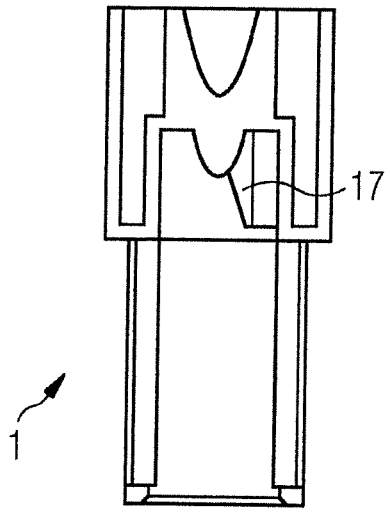
FIG. 5 shows a sectional illustration of a contact slide in accordance with the invention.
Figure 6:
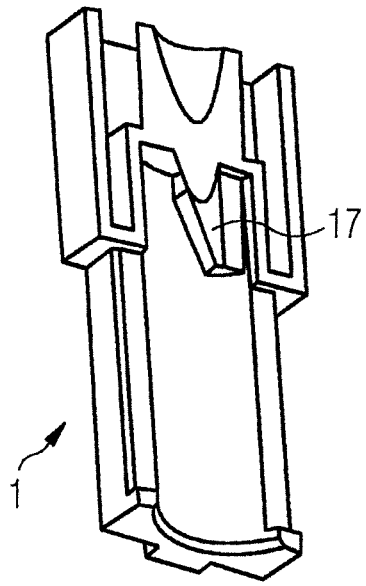
FIG. 6 shows a perspective sectional illustration of a contact slide in accordance with the invention.

FIG. 5 shows the contact slide 1 in accordance with the invention in a sectional illustration. It is clear from FIG. 5 that a second insertion bevel 17 is also formed in the contact slide 1. The first insertion bevels 13 on the guide webs 11, 12 of the rotation prevention device 9 cooperate with the second insertion bevels 17 in the contact slide 1. The insertion bevel 17 of the contact slide 1 in accordance with the invention can also be seen in a perspective sectional illustration in FIG. 6.

Figure 7:
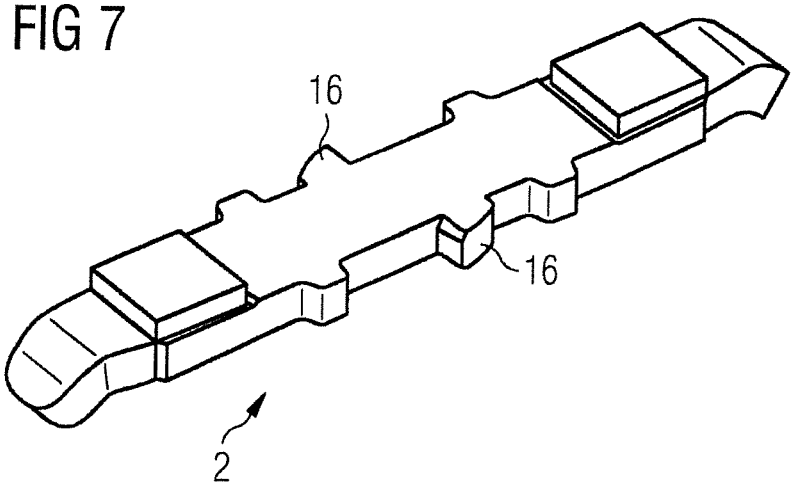
FIG. 7 shows a perspective illustration of a movable switching piece in accordance with the invention.

FIG. 7 shows a movable switching piece 2 in accordance with the invention with the protrusions 16 that are arranged in a mirror-inverted manner obliquely opposite one another. Here, mirror-inverted means that the protrusions 16 are arranged with respect to one another in a rotationally symmetrical manner, where the rotation axis extend perpendicularly from the longitudinal axis of the movable switching piece 2.

Figure 8:
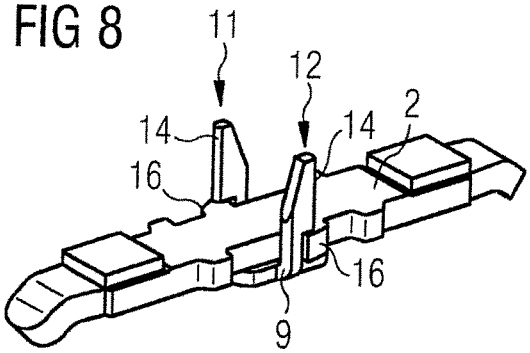
FIG. 8 shows a perspective side illustration of a movable switching piece with a rotation prevention device in accordance with the invention.

FIG. 8 illustrates a movable switching piece 2 with a rotation prevention device 9 in accordance with the invention. It is clear from this illustration that the straight insertion portions 14 on the guide webs 11, 12 of the rotation prevention device 9 bear against the protrusions 16 of the movable switching piece 2.

Figure 9:
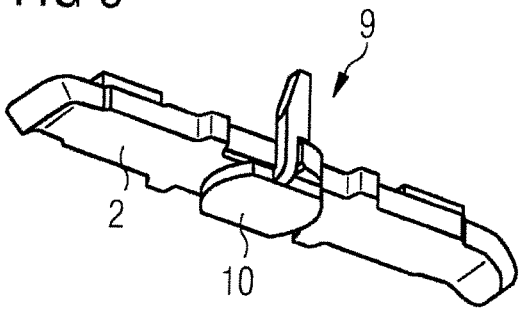
FIG. 9 shows a perspective illustration from below of a movable switching piece with the rotation prevention device in accordance with the invention.

FIG. 9 shows the illustration from FIG. 8 from below. It is clear from this illustration that the movable switching piece 2 rests on the support plate 10 of the rotation prevention device 9.

Figure 10:
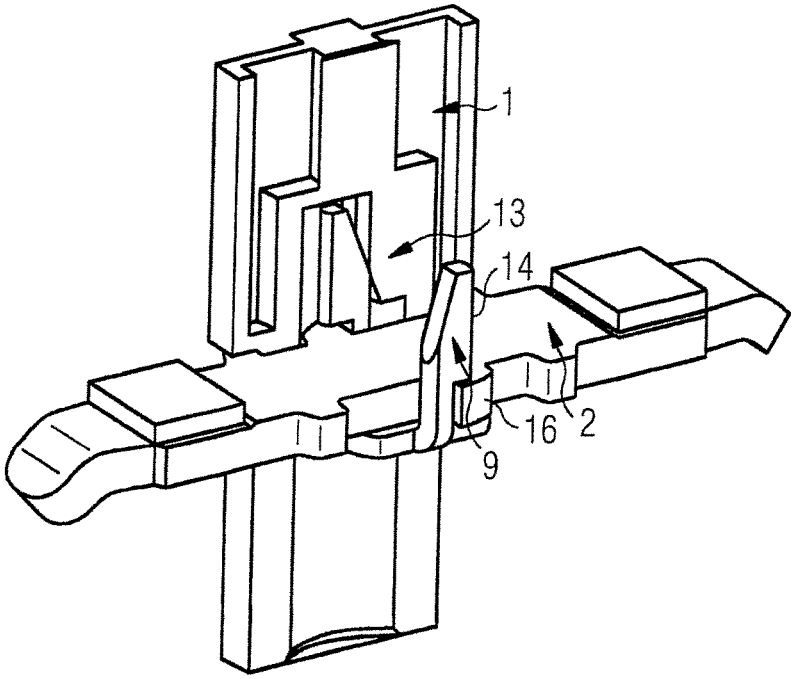
FIG. 10 shows a perspective sectional illustration of a contact slide with an inserted movable switching piece and rotation prevention device.

FIG. 10 shows the arrangement of the movable switching piece 2 and rotation prevention device 9 as positioned in the contact slide 1 in accordance with the invention. In the final mounting position of the rotation prevention device 9, the insertion bevels 14 of the guide webs 11, 12 of the rotation prevention device 9 bear against the protrusions 16 of the movable switching piece 2. These protrusions 16 have the effect that the movable switching piece 2 does not produce any bridge rotator.

The contact slide unit in accordance with the invention is characterized by the connection of the movable switching piece to the rotation prevention device, with the result that the guide surfaces of the movable switching piece can be considerably increased. Even in the event of eccentric introduction of current constriction forces and current-loop forces, which act on the bridge in the event of a short circuit and throw it against the impact domes in the lower part, the bridge is guided effectively by the metal rotation prevention plate.

Figure 11:
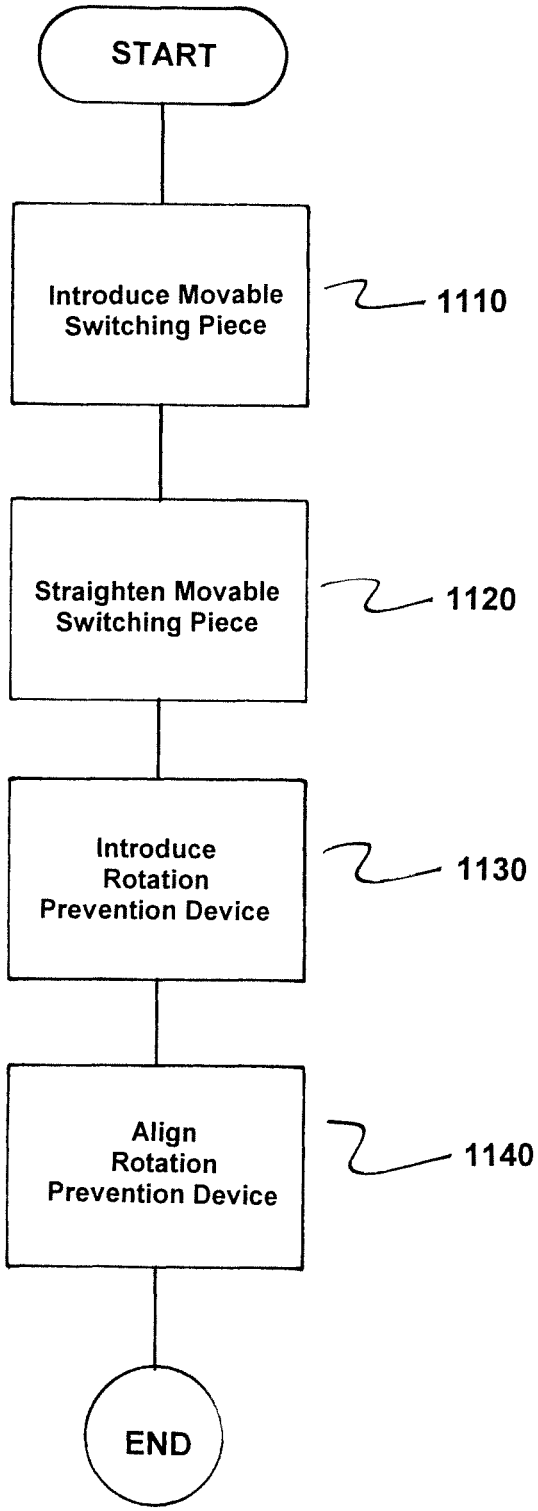
FIG. 11 is a flowchart of the method in accordance with the invention.

FIG. 11 is a flowchart of a method for mounting a contact slide unit for a switching unit having a contact slide (1) with a movable switching piece (2) guided therein. The method comprises introducing the movable switching piece (2) obliquely between lateral guides (4, 5) of the contact slide (1), as indicated in step 1110.

Next, the movable switching piece (2) straightened up on the feet (6) of the contact slide (1), as indicated in step 1120.

Next, a rotation prevention device (9) is introduced into an opening in the contact slide (1), as indicated in step 1130.

The rotation prevention device (9) is now aligned with the movable switching piece (2) in the contact slide (1), as indicated in step 1140.

While there have been shown, described and pointed out fundamental novel features of the invention as applied to a preferred embodiment thereof, it will be understood that various omissions and substitutions and changes in the form and details of the methods described and the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A method for mounting a contact slide unit for a switching unit having a contact slide with a movable switching piece having two protrusions arranged in a mirror-inverted manner opposite one another and guided therein, the method comprising:

introducing the movable switching piece obliquely between lateral guides of the contact slide;

straightening up the movable switching piece on feet of the contact slide;

introducing a rotation prevention device into an opening in the contact slide; and aligning the rotation prevention device with the movable switching piece in the contact slide to bear against the two protrusions of the movable switching piece after the rotation prevention device is rotated to its final mounting position;

wherein the rotation prevention device is configured in a U-shaped manner with a support plate as a central region with two guide webs arranged laterally thereon.

2. A contact slide unit for a switching unit, comprising:

a movable switching piece;

a contact slide having the movable switching piece guided therein; and a separately configured rotation prevention device;

wherein the movable switching piece is positioned in the contact slide in a manner such that it is prevented from rotating by the separately configured rotation prevention device; and wherein the rotation prevention device is configured in a U-shaped manner with a support plate as a central region with two guide webs arranged laterally thereon.

3. The contact slide unit as claimed in claim 2, wherein the rotation prevention device is a stamped and bent sheet-metal part.

4. The contact slide unit as claimed in claim 2, wherein the guide webs of the rotation prevention device have first insertion bevels.

5. The contact slide unit as claimed in claim 4, wherein the first insertion bevels are arranged on the rotation prevention device in a mirror-inverted manner opposite one another.

6. The contact slide unit as claimed in claim 5, wherein second insertion bevels, upon which the first insertion bevels of the rotation prevention device are guided during the positioning of the rotation prevention device in the contact slide, are arranged in the contact slide.

7. The contact slide unit as claimed in claim 4, wherein second insertion bevels, upon which the first insertion bevels of the rotation prevention device are guided during the positioning of the rotation prevention device in the contact slide, are arranged in the contact slide.

8. The contact slide unit as claimed in claim 2, wherein protrusions are formed on the movable switching piece such that said protrusions hold the rotation prevention device in a manner prevented from rotating in its final mounting position on the movable switching piece.

9. A circuit breaker having a contact slide unit as claimed in claim 2.

* * * * *